US007080676B2

(12) United States Patent
Abelson et al.

(10) Patent No.: US 7,080,676 B2
(45) Date of Patent: Jul. 25, 2006

(54) FENESTRATION UNIT WITH SCREEN COIL APPARATUS

(75) Inventors: Matthew D. Abelson, Somerville, MA (US); Peter K. Bates, Framingham, MA (US); David P. Chastain, Acton, MA (US); Zivthan A. Dubrovsky, Waltham, MA (US); Bruce P. Macrae, Danvers, MA (US); Wayne T. Brezovar, St. Louis Park, MN (US); Timothy J. Kelley, Stillwater, MN (US); David D. Plummer, Hudson, WI (US)

(73) Assignee: Andersen Corporation, Bayport, MN (US)

( * ) Notice: Subject to any disclaimer, the term of this patent is extended or adjusted under 35 U.S.C. 154(b) by 161 days.

(21) Appl. No.: 10/485,897

(22) PCT Filed: Aug. 7, 2001

(86) PCT No.: PCT/US01/24695

§ 371 (c)(1),
(2), (4) Date: Feb. 5, 2004

(87) PCT Pub. No.: WO03/014515

PCT Pub. Date: Feb. 20, 2003

(65) Prior Publication Data

US 2005/0173075 A1 Aug. 11, 2005

(51) Int. Cl.
*A47G 5/02* (2006.01)

(52) U.S. Cl. ..... 160/30; 160/99

(58) Field of Classification Search ..... 160/99, 160/100, 273.1, 243, 27, 28, 30
See application file for complete search history.

(56) References Cited

U.S. PATENT DOCUMENTS

| | | | | | |
|---|---|---|---|---|---|
| 549,495 | A | * | 11/1895 | Crocker | 160/30 |
| 1,458,617 | A | * | 6/1923 | De Smidt | 160/99 |
| 2,239,006 | A | * | 4/1941 | Krywonis | 160/30 |
| 2,323,295 | A | * | 7/1943 | Brewer | 160/99 |
| 2,560,440 | A | * | 7/1951 | Heeren | 160/30 |
| 2,595,364 | A | | 5/1952 | Lockhart | 160/313 |
| 6,059,007 | A | | 5/2000 | Tomita | 160/242 |

* cited by examiner

*Primary Examiner*—Blair M. Johnson
(74) *Attorney, Agent, or Firm*—Womble Carlyle Sandridge & Rice, PLLC

(57) ABSTRACT

A fenestration unit including screen coil apparatus is provided by the invention. The fenestration unit includes a frame defining an opening. A sash- is slideably received by the opening of the frame. The fenestration unit includes a screen coil assembly attached to the sash. The screen coil assembly includes a screen having first and second edges, and a roll core, wherein the screen is capable of being coiled and uncoiled on the roll core. The fenestration unit further includes an edge support having first and second support members having at least a portion located between the frame and the sash, the first and second support members for fastening to the screen first and second edges.

18 Claims, 10 Drawing Sheets

FIGURE 2: DOUBLE SPRUNG CORE

FENESTRATION UNIT WITH SCREEN COIL APPARATUS

FIELD OF THE INVENTION

The invention relates to fenestration units having a screen coil apparatus. More specifically, the invention relates to a fenestration unit with screen coil assembly and an edge support for securing the edges of a screen.

BACKGROUND OF THE INVENTION

Traditional window units utilize a screen permanently attached to a screen frame. The result is that the screen is always obstructing the view through the window even when the window is closed and the screen is not needed. In the traditional window screen, the screen and screen frame must be removed from the window and placed in storage to eliminate this obstruction to the view. U.S. Pat. No. 5,915,443 discloses a window screen that can be concealed in the bottom lateral member of the sash of a hung window and unwound as the sash is raised thus providing an automatic window screen.

SUMMARY OF THE INVENTION

A fenestration unit including screen coil apparatus is provided by the invention. The fenestration unit includes a frame defining an opening. A sash—is slideably received by the opening of the frame. The fenestration unit includes a screen coil assembly attached to the sash. The screen coil assembly includes a screen having first and second edges, and a roll core, wherein the screen is capable of being coiled and uncoiled on the roll core. The fenestration unit further includes an edge support having first and second support members having at least a portion located between the frame and the sash, the first and second support members for fastening to the screen first and second edges.

Figure 1:
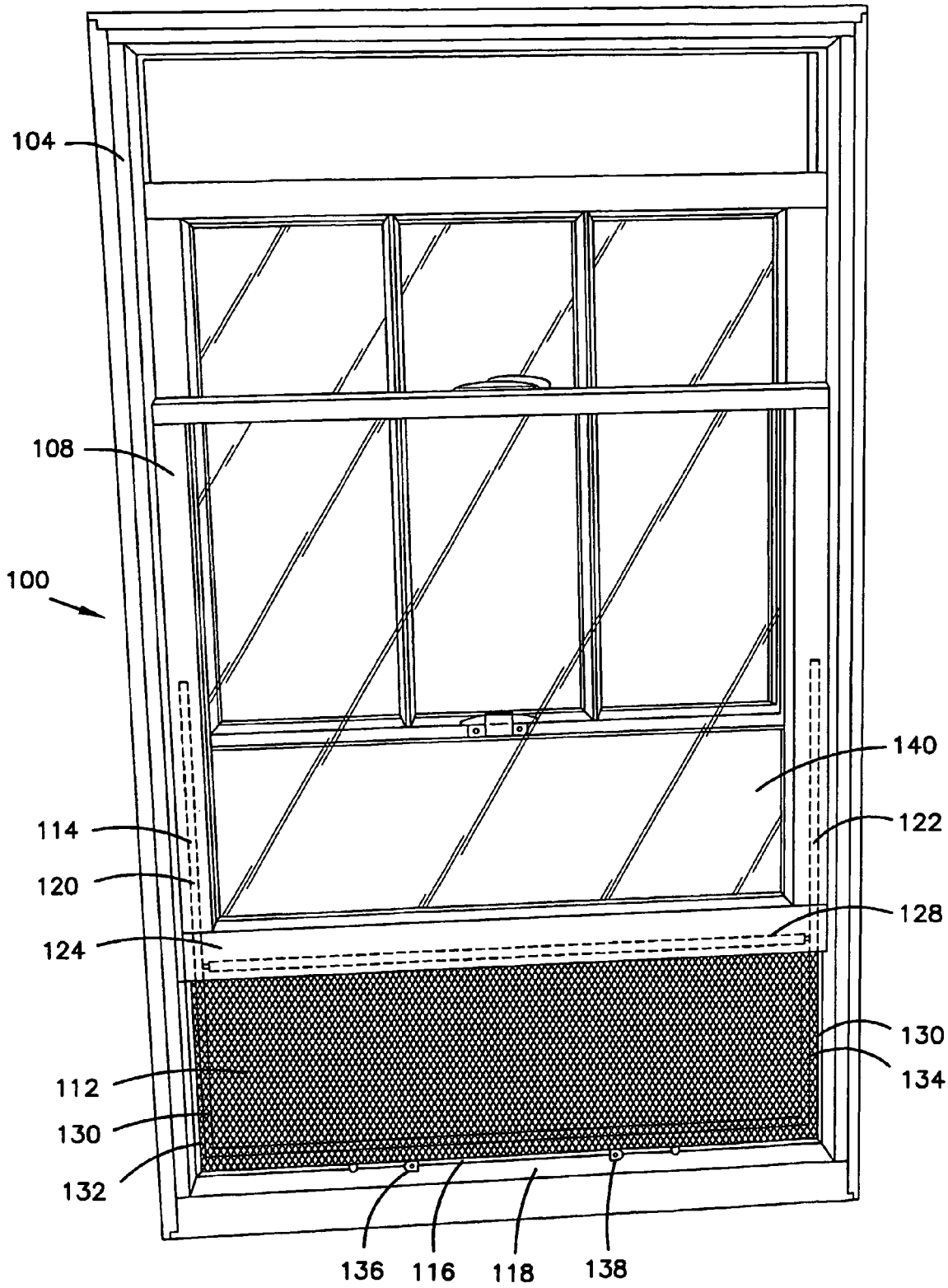
FIG. 1 is a perspective illustration of a window unit according to the principles of the present invention.

While the invention is amenable to many modifications and alternative forms, specifics thereof have been shown by way of example in the drawings and will be described in detail. It should be understood, however, that the intention is not to limit the invention to the particular embodiments described. On the contrary, the intention is to cover all modifications, equivalents and alternatives following within the spirit and the scope of the invention as defined by the appended claims.

DETAILED DESCRIPTION OF VARIOUS EMBODIMENTS

The present invention relates to a fenestration unit having a screen coil apparatus for concealing the screen when the screen is not being used. For purposes of this invention, a fenestration unit includes any window, door or other apparatus for filling an opening in a building structure.

The fenestration unit including screen coil assembly of the present invention includes a frame defining an opening and a sash slidably received by the opening. The frame includes a first member that the sliding sash moves away from when opening the fenestration unit and toward when closing it. The term "sash" is used broadly herein to include any member regardless of whether it supports glass or other traditional window sash aspects. For example, a sliding sash may be a window sash or it could be any other sliding member such as a sliding door or panel. Furthermore, a sliding sash may be a hung window where the sash slides vertically, a horizontally sliding sash, or a roof window sash such that the sliding sash may be oriented horizontally or at an angle to horizontal.

A roll core onto which a screen can be coiled is attached to the sash. A roll core is any apparatus capable of receiving a screen in a coiled configuration. Some specific embodiments of roll cores are discussed below.

A screen is also provided with one end of the screen attached to a first member of the frame and the opposite end attached to the roll core. For purposes of this invention, a screen may be any material, cloth, fabric, sheet, or other member capable of being coiled into a wound configuration and uncoiled into a generally, but not necessarily exactly, planar configuration. In one embodiment, the screen is a common window insect screen material such as vinyl covered fiberglass screen mesh.

When the sash is closed, the screen is coiled onto the roll core. As the sash slides in an opening direction, away from the first member of the frame, the screen is uncoiled so as to extend across the opening created by opening the sash. As the sash slides in a closing direction, toward the first member of the frame, the screen coils back onto the roll core so that the screen is substantially hidden, if not completely hidden.

The screen includes first and second edges that are perpendicular to the screen ends. It is desirable to secure the first and second edges of the screen so that insects cannot pass through the fenestration unit around the edges of the screen. There may be other reasons for securing the screen edges. The present invention therefore includes an edge support including first and second support members located between the frame and sash and extending longitudinally parallel to the sliding motion of the sash. The first and second support members provide a structure upon which the screen edges can be removably secured.

First and second support members provide sufficient rigidity and support to provide an interface upon which the screen can be attached. Therefore, the first and second support members include a structural component and a fastening component. The structural and fastening components may be integral such as a fastener extruded in one piece with a structural member. Alternatively, the first and second structural members may be two attached pieces such as a fastener attached to a structural member.

In one embodiment, the edge support is a track and fasteners attached to the track. In such an embodiment, the first support member is a first fastener attached to a first track member. The second support member is a second fastener attached to a second track member. More details of this particular embodiment of an edge support are provided below.

As the screen is uncoiled from the roll core, the first and second edges of the screen may be removably secured to the first and second support members respectively.

For purposes of this invention, it is important to note that the first and second support members may be integral with the frame. That is, the first and second support members may be formed as part of the frame members such as, for example, through extrusion of the frame and first and second support members as one piece. Alternatively, the first and second support members may be structures that are not integral with the frame but rather are adjacent to the frame. Alternatively, the first and second support members may be structures that are integral with or adjacent to another component that is adjacent to the frame member such as a jambliner, weatherstrip or other component.

A fastener for purposes of this invention may be any device, apparatus, material or structure that is capable of removably fastening to a screen. As discussed above, a fastener may be a separate member that is attached to a track, or it may be an integral component of a support member. In one embodiment, the fastener may be a reclosable fastener capable of being removably secured to a loop structure as may exist on a screen edge. One form of a reclosable fastener is a hook and loop fastener. Specifically, the hook portion of a hook and loop fastener would be removably secured to the screen and would be the "fastener" in such an example. In this embodiment, the screen itself acts as the loop portion of the fastener that may be removably fastened to the hooks of the fastener. Other reclosable fasteners include mushroom shaped fasteners that also fasten directly to the screen by placement of a mushroom head through a screen loop as will be discussed further below. In another example, a fastener may be a magnet that is capable of being removably secured to a screen edge. In such an embodiment, the screen edge would be a ferrous material or would have a ferrous material affixed to the screen edge. Another example fastener may be an adhesive or other substance capable of being reattached multiple times to a screen edge. As one skilled in the art would understand, many different types of fasteners can be envisioned for use with the present invention. The scope of this invention is not to be limited by the specific examples detailed herein.

In some embodiments of the invention, it may be desirable to include a fastening assist. A fastening assist is a mechanism, member or material that assists in removably attaching the screen to the support member or a fastener which is part of a support member. In the specific example where the fastener is a reclosable fastener, the fastening assist might be an insertion finger that forces the screen onto the fastener as the screen comes off the roll core. Such an insertion finger might simply be an immovable member with an end that is sufficiently proximate to the fastener to press the screen onto the fastener as the screen passes between the insertion finger and the fastener. In another embodiment described in more detail below, the fastening assist might be a feed wheel. Different support members may require different fastening assists.

Referring now to the several figures in which identical elements are numbered identically throughout, a brief description of various embodiments of the present invention will now be provided. Referring now to FIG. 1, a fenestration unit, specifically in this embodiment, a double hung window 100 is provided. Double hung window 100 includes a frame 104, a sash 108 that slides up and down in the frame 104, roll core 128, screen 112 and U-shaped track 114. Frame 104 includes sill 118 which is one embodiment of a frame first member. The U-shaped track includes first and second track members 120 and 122 situated longitudinally vertical so as to be slidably received between the frame 104 and the sash 108. First and second track members 120 and 122 are connected by perpendicular header 116. Header 116 is removably secured to the sill 118 by clips 136 and 138. Sash 108 includes a bottom rail 124 that defines an opening 126 (see FIG. 2) for receipt of a roll core 128 for coiling and uncoiling of the screen 112. A reclosable fastener 130 is adhesively secured to first and second track members 120 and 122 for attachment to the edges 132 and 134 of the screen 112.

The operation of the embodiment shown in FIG. 1 is as follows. In normal operation, the header 116 of the U-shaped track 114 is attached to the sill 118 by clips 136 and 138. When the window 100 is closed, such that sash 108 is pushed down so that it is in contact with sill 118, the screen 112 is coiled onto roll core 128. Therefore, the screen does not obstruct the view passing through the glass 140. As the sash is lifted, resulting in the opening of the window 100, the screen is partially uncoiled from roll core 128 to provide protection from insects or any other type of function that a screen may provide. As the screen is uncoiled, a fastening assist, such as a feed wheel 140 shown in FIG. 2, presses the edges 132 and 134 of the screen 112 onto the reclosable fasteners 130 resulting in removable attachment of the screen edges 132 and 134 to the first and second track members 120 and 122, respectively. As the window is returned to its closed position, the screen 112 is removed from the reclosable fasteners 130 and simultaneously coiled onto roll core 128.

For purposes of egress, the clips 136 and 138, may be rotated to release the header 116 from the sill 118. The track 114 may then be pushed up into the sash 108 resulting in coiling of the screen 112 and allowing for egress through the window. Of course one skilled in the art will recognize that many different types of clips or other fastening structures may be utilized to removably hold the header 116 to the sill 118. Such a fastening structure would not have to rotate but could have other means of fastening the header to the sill. For example, a sliding mechanism could be utilized that slides perpendicular to the longitudinal direction of the header 116 so that when it is slid toward the header 116 it holds the header to the sill 118 and when it is slid away from the header it releases the header 116 from the sill 118.

Figure 2:
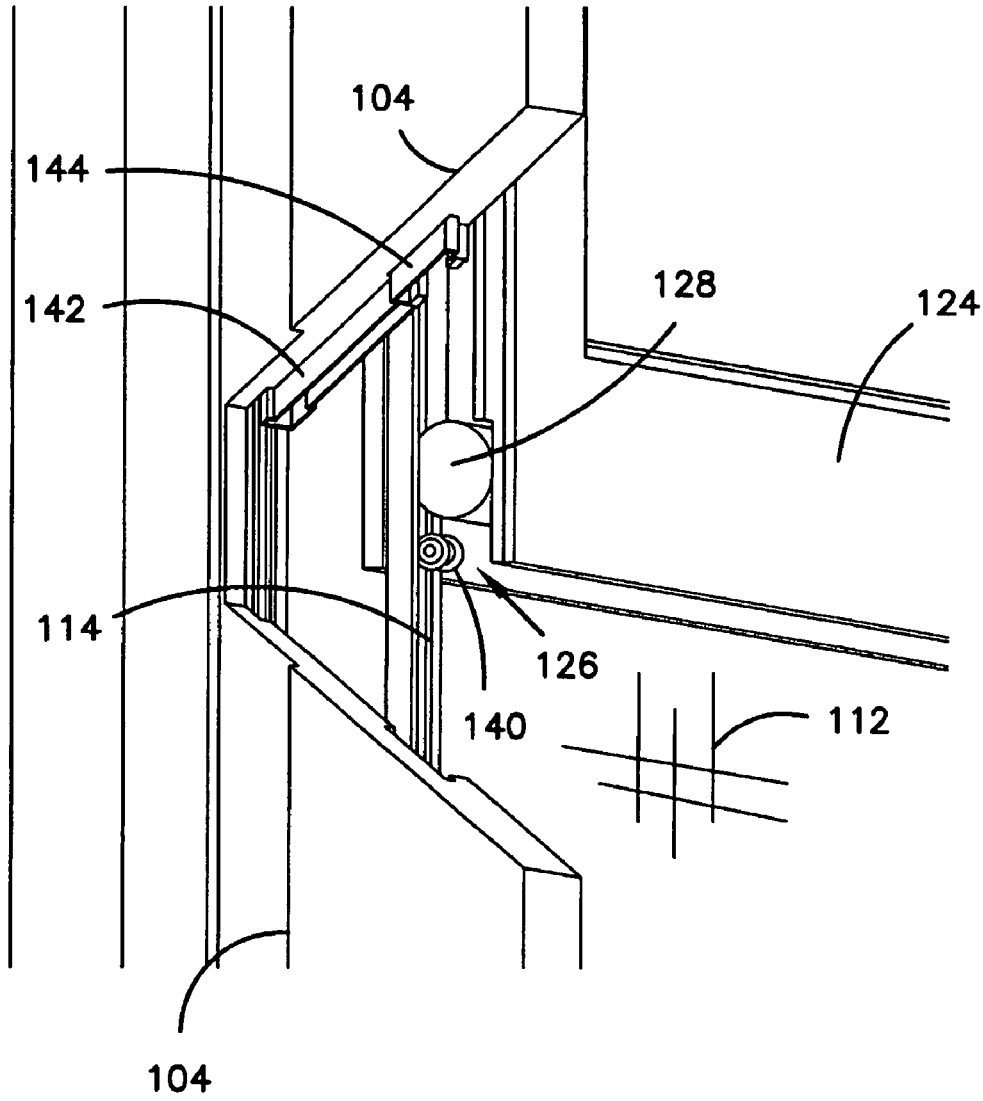
FIG. 2 is a perspective cut-away view of a portion of a window unit according to the principles of the present invention.
Figure 3:
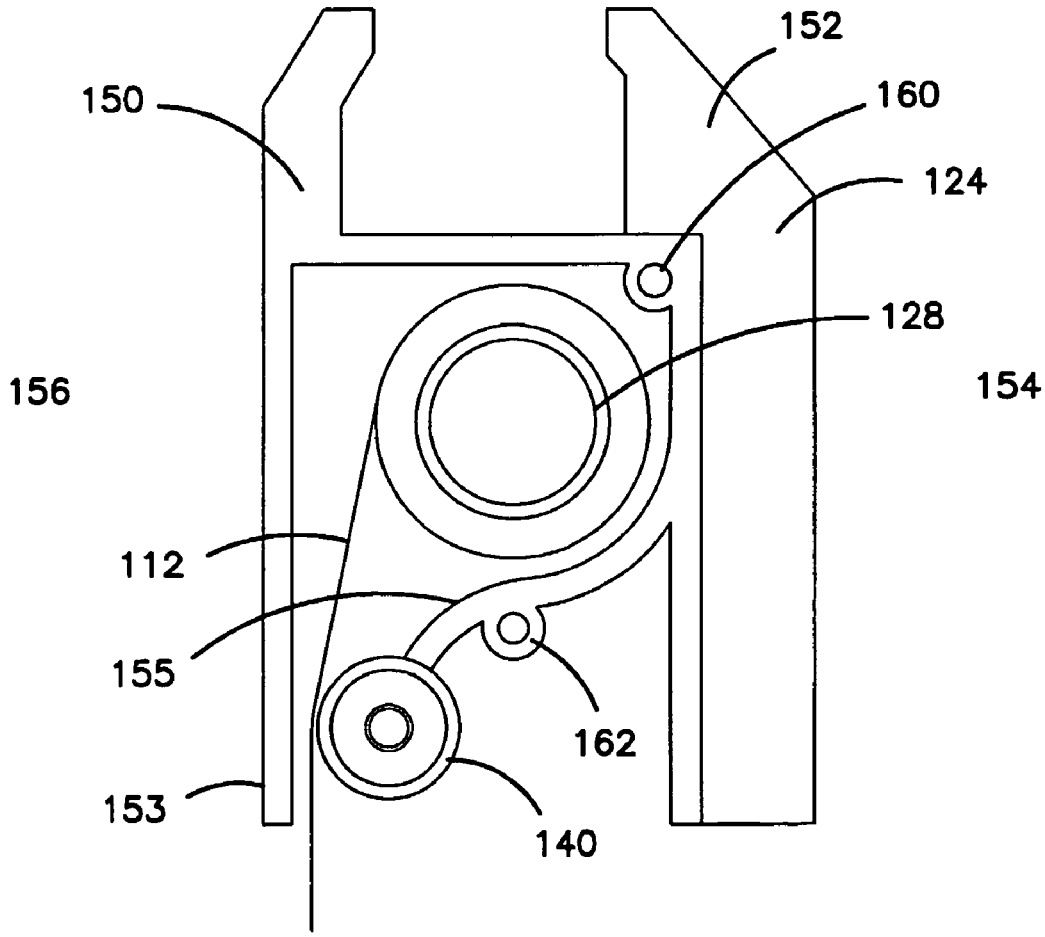
FIG. 3 is a side view of a lower rail of a lower sash of a double hung window unit according to the principles of the present invention.

FIG. 2 is a perspective view of a portion of window 100 with a partial cutaway of the frame 104 to reveal the opening 126 in bottom rail 124 and the receipt therein of roll core 128. FIG. 2 also shows feed wheel 140 and its interaction with track 114. It should be appreciated that the opposite side of the window 100 and sash 108 (the side including opposite end of roll core 128 as shown in FIG. 2 and showing track member 122) is not shown because it is a mirror image of the side shown in FIG. 2. FIG. 2 also reveals jambliner 142 and flexible weatherstrip 144 both situated between the frame 104 and the track 114. An example jambliner and flexible weatherstrip is provided in pending U.S. patent application Ser. No. 09/605,501, filed Jun. 28, 2000 and having common assignee with this application, such application herein incorporated by reference. FIG. 3 is a side view of bottom rail 124 of sash 108 including roll core 128, screen 112, and feed wheel 140.

In the embodiment shown, the bottom rail 124 is a composite of aluminum and wood with member 150 being aluminum and member 152 being wood. Member 150 is an aluminum extrusion that provides a structural component while the wood 152 provides a desirable interior appearance. The feed wheel 140 is supported by an arm 155 of the aluminum extrusion 150. It will be understood by one skilled in the art, however, that many different materials and combinations of materials may be used to construct the rail member 124. For example, the rail member 124 could be made entirely of wood, entirely of aluminum, entirely of a composite, entirely of poly vinyl chloride or potentially of any combination of these materials or any other material that would meet the structural requirements of a bottom rail in a sash and that can structurally support a roll core. It is noted that the interior of the window is designated with reference numeral 154 and the exterior with reference numeral 156.

Figure 4:
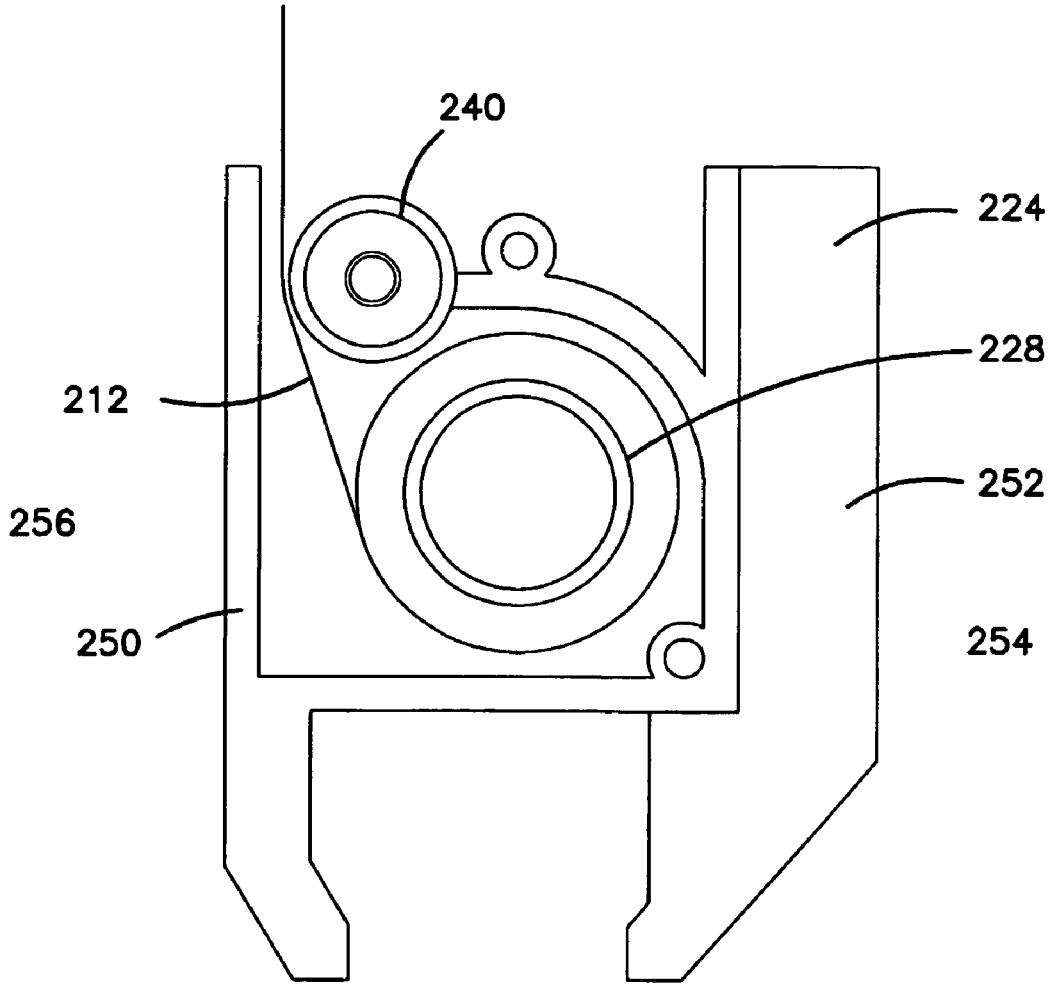
FIG. 4 is a side view of an upper rail of an upper sash of a double hung window unit according to the principles of the present invention.

It is important to note that the present invention may be embodied in many different types of sliding sashes of many different types of fenestration units. For example, in a double-hung window with a lower sash and an upper sash, this invention could also be embodied in the upper sash such that lowering of the upper sash results in a screen covering the opening between the top rail of the upper sash and the frame member above it. A side view of one embodiment of an upper sash with a screen coil assembly is shown in FIG. 4. Upper rail 224 of an upper sash is provided including roll core 228, screen 212 and feed wheel 240. In this particular embodiment, the upper rail 224 is made of an aluminum member 250 and a wood member 252. The interior of the window is designated by numeral 254 and the exterior by numeral 256.

In the case of a horizontally sliding sash, the roll core may be vertically attached to the side stile. For example, the roll core may be attached to the side stile of a gliding window or to the side stile of a sliding door. In such cases, the first and second track members would be horizontally positioned.

Turning our attention now to the track, it is noted that the embodiment of the track shown in the Figures holds the screen along three of its edges. The track can slide in and out of the sash and creates the user interface with the screen. It may be desirable to utilize a track that is rigid both in the beam profile of the track as well as the corner attachments. If the track is allowed to flex and twist, it may be difficult to slide it into the sash. If the track is allowed to flex too much, the frame can become jammed, making the screen inoperable. It is also desirable for the frame to have the smallest profile possible in order to minimize the amount of material removed from the sash.

The track can be made of any material that is sufficiently rigid to provide an interface to attach the screen edges. Some example materials that might be used for a track are aluminum, steel and composites including wood fiber composites such as FIBREX™ material developed by Andersen Corporation. Both aluminum and steel track have been successfully utilized. In one prototype, an aluminum track was used. This track was 0.125 inches thick and had an "L" shaped profile. The legs of the L were 0.75 inches and 0.375 inches with the longer leg being the portion coplanar with the window.

Using steel, a smaller frame profile could be used with satisfactory results. Exemplary dimensions for a steel track are an L shaped profile 0.048 inches thick having legs of lengths 0.625 inches and 0.350 inches. With the larger leg of this profile again being coplanar with the window unit. If a 0.5 inch wide recloseable fastener strip is used, and applied to the longer leg of the profile, there is an extra 0.071 inches of space between the fastener strip and the opposing leg of the track profile (see for example FIG. 5). This extra space is needed for screen overlap. The screen overlap can take up variances in tolerance and variances in how the screen is rolled out onto the tracks.

The corners of the track are an important detail of the track design. The corner plays a large part in the robustness of the track assembly. The corners could be welded or possibly riveted together to provide a rigid joint.

The orientation of the fastener strip affects the push out force of the screen. The greatest push out force is achieved when the reclosable fastener strip is facing inwards, toward the interior of the house. In this orientation, outward forces on the screen mesh result in further engagement of the screen loops with the hooks, mushrooms, or other reclosable fastener members of the reclosable fastener. In this scenario, the screen was tested to have a push out force of approximately thirty pounds.

The steel track could be galvanized to improve its corrosion resistance.

End caps may be constructed and attached to the first member of the sash such as, for example, to the bottom rail 124 shown in FIG. 3. Such an end cap in this embodiment, would be attached to the bottom rail 124 by screwing or riveting it onto mounting points 160 and 162. The end caps may be made out of any material that will help constrain and guide the track in its travel in and out of the sash. For example, 0.020 galvanized steel could be used.

Figure 5A:
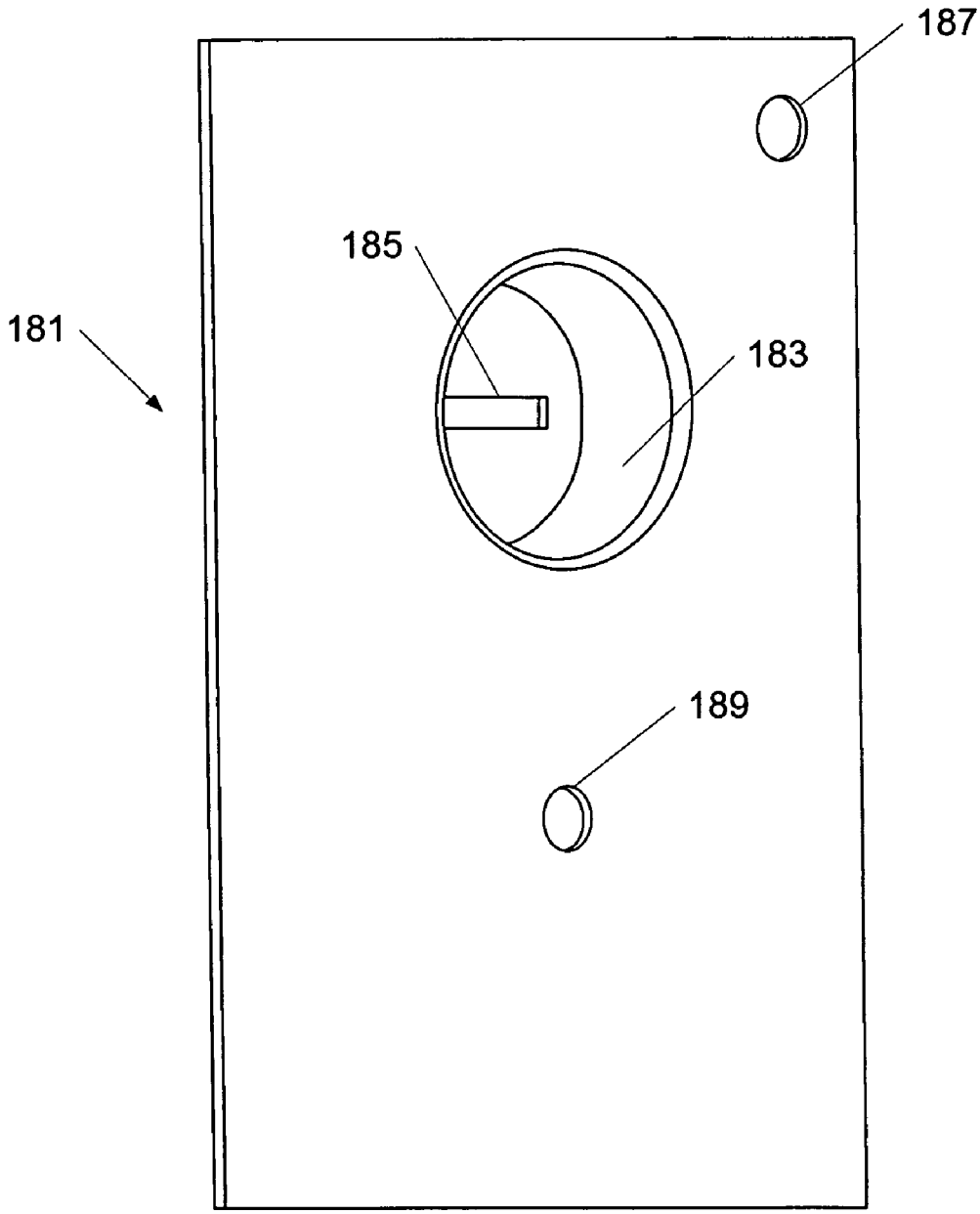
FIG. 5A is a perspective inside view of an end cap according to the principles of the present invention.
Figure 5B:
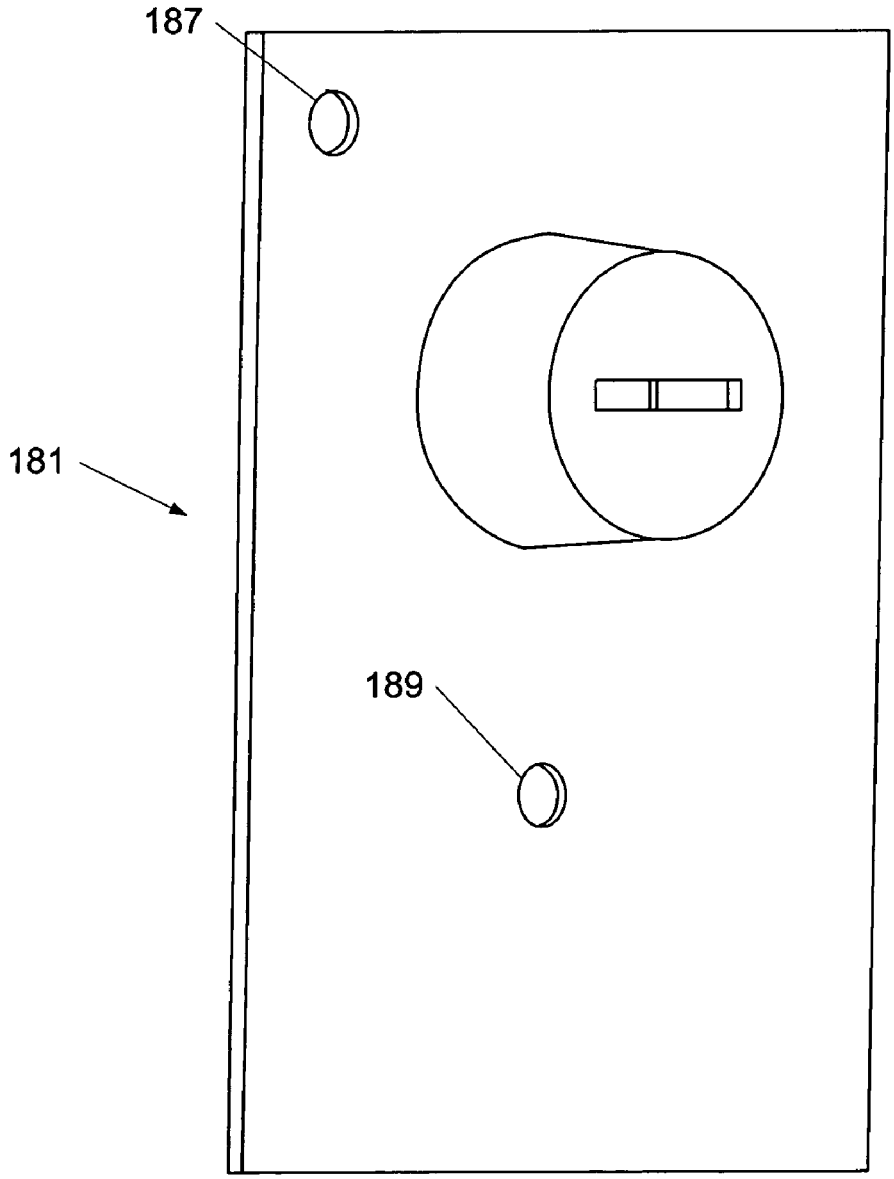
FIG. 5B is a perspective outside view of an end cap according to the principles of the present invention.

FIGS. 5A and 5B are inside and outside views of one embodiment end cap 181. FIG. 5A is a view of the end cap as viewed from the roll core. One end cap is to be placed on each end of the roll core. The end of roll core 128 fits into the circular receptacle 183 formed in the end cap. Rectangular receptacle 185 within receptacle 183 receives a spade in the end of roll core 128. Mounting points 187 and 189 align with mounting points 160 and 162. FIG. 5B is an opposite view of end cap 181 from that shown in FIG. 5A.

Figure 6:
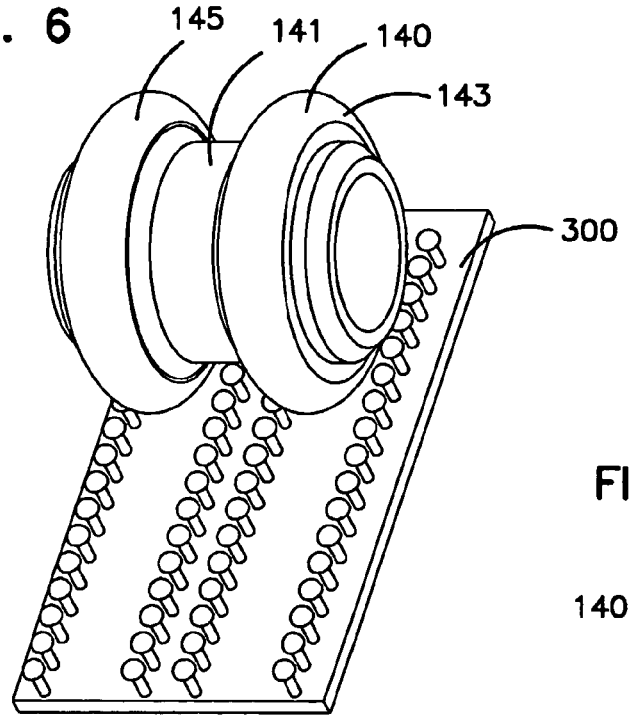
FIG. 6 is a perspective view of a feed wheel and fastener according to the principles of the present invention.
Figure 7:
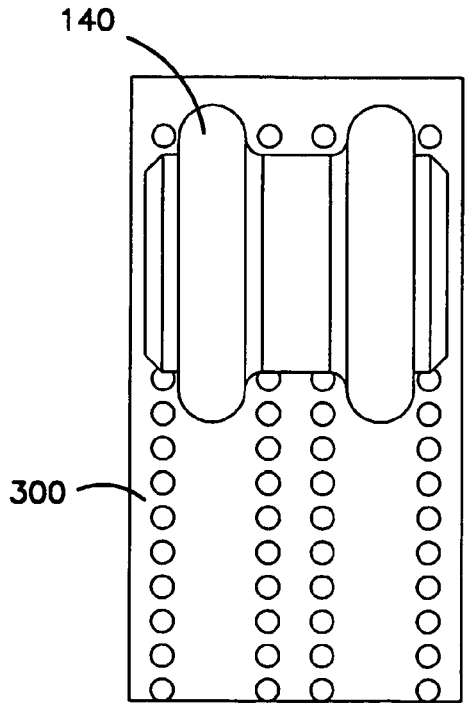
FIG. 7 is a top view of a feed wheel and fastener according to the principles of the present invention.
Figure 8:
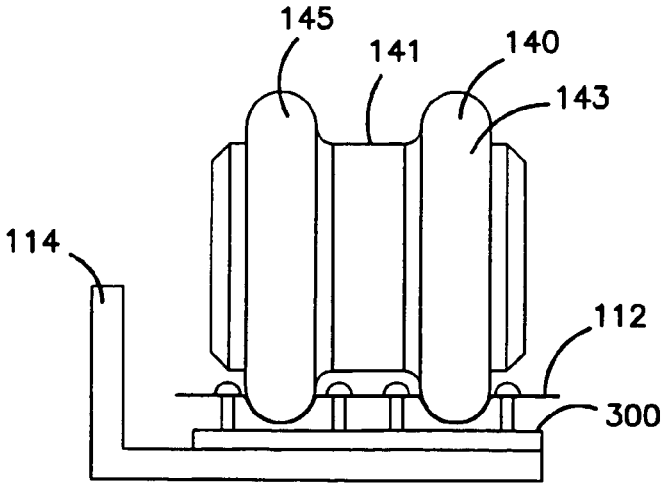
FIG. 8 is a side view of a feed wheel, screen, fastener and track according to the principles of the present invention.
Figure 9:
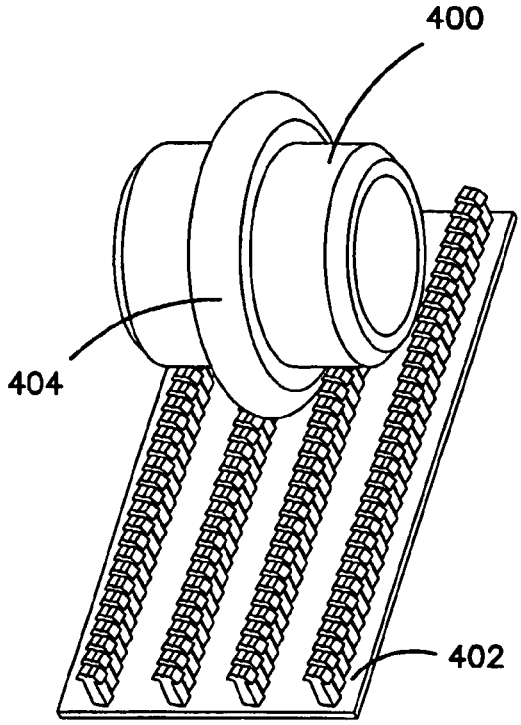
FIG. 9 is an alternative embodiment of a feed wheel and a fastener according to the principles of the present invention.
Figure 10:
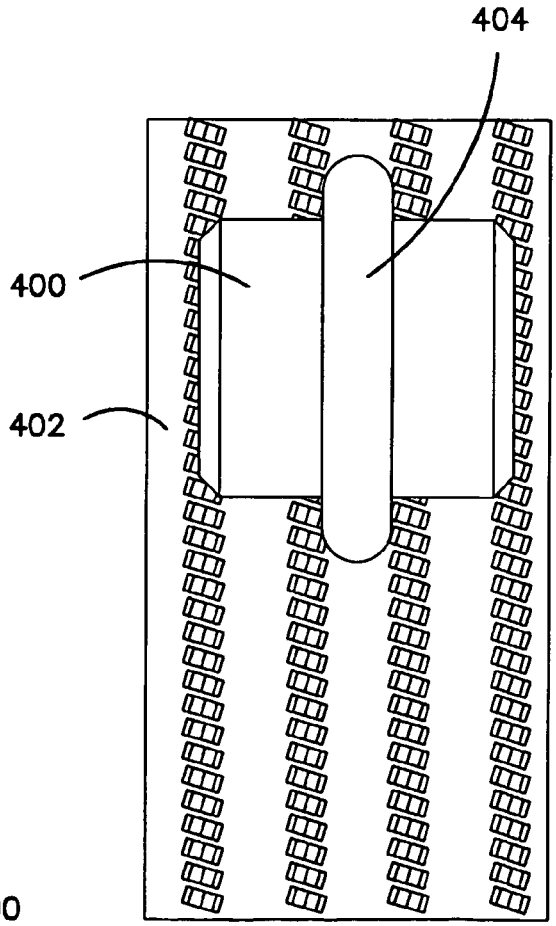
FIG. 10 is a top view of an alternative embodiment of a feed wheel and a fastener according to the principles of the present invention.
Figure 11:
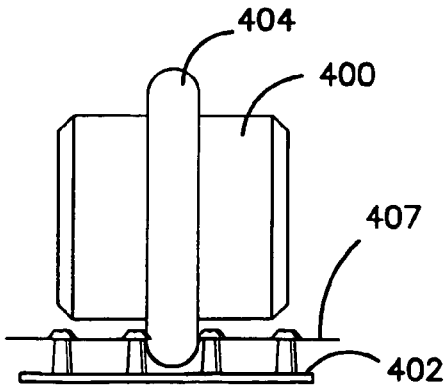
FIG. 11 is a side view of an alternative embodiment of a feed wheel, screen and a fastener according to the principles of the present invention.

Referring now to FIG. 8, a track 114, with a mushroom fastener 300 adhesively attached to the track 114, screen 112 and feed wheel 140 is provided. It is noted that the screen may not necessarily attach to all of the mushroom heads. FIGS. 6–7 illustrate different views of FIG. 8 not including the track 114 and screen 112. FIGS. 9–11 illustrate various views of an alternate embodiment of a feed wheel, particularly feed wheel 400 and its relationship to a further alternative embodiment of a reclosable fastener, specifically reclosable fastener 402. Feed wheel 400 has a single O-ring 404. Screen 407 is only provided in FIG. 11.

A feed wheel can be made of any material that provides sufficient rigidity to apply a screen to a fastener. For example, the feed wheel could be made of ABS or aluminum. In order to improve screen life, O-rings may be applied to the edges of the aluminum wheels. This reduces wear on the screen, because the O-rings cushion the force of the feed wheel on the screen. The feed wheel 140 includes hub 141 and O-rings 143 and 145. Hub 141 is made of aluminum in this embodiment.

Turning now to some specific embodiments of reclosable fasteners, it should be understood that for the purposes of this invention, the term "reclosable fastener" should be interpreted broadly to include all different shapes and sizes of hooks, mushrooms and other shapes that might be attached to a track, or be an integral part of a track, and that are capable of mating with screen loops to result in a fastened condition relative to the screen. For example, the mushroom fastener 300 shown in FIGS. 6–8 is a product made by Minnesota Mining and Manufacturing named Dual Lock® 170 reclosable fastener that has been modified as shown. 3M Dual Lock® reclosable fastener is made in three different mushroom densities: 170, 250 and 400 mushrooms per square inch. Mushroom height is 0.0725 inches. Dual Lock® reclosable fastener is available in one inch wide rolls, so it has been cut to an appropriate width for this particular embodiment. In the embodiment shown in FIGS. 6–8, rows of mushrooms were removed so that the feed wheel had a space between rows of the mushrooms to roll within. After the screen mesh is pushed over the mushroom head, it is captured by the flat underside of the mushroom. The screen is held securely because each head acts as a clamp on a strand of the screen mesh. This provided very good push-out force for the screen.

The reclosable fastener 402 shown in FIGS. 9–11 is Aplix® High Sheer Hook Tape sold by Aplix Corporation of Paris, France. Aplix® High Sheer Hook Tape has a hook height of 0.090 inches and a hook count of 160 per square inch. The hooks in the Aplix® material are orientated almost perpendicular to the length of the material as shown in the FIGS. 9–11. In addition, there is approximately 0.080 inches between rows of hooks. This space allowed the feed wheel to mate the screen to the hooks without having to alter the material. Aplix® High Sheer Hook Tape is available in one inch rolls, so it has been cut to size in this particular embodiment. As the feed wheel travels along the Aplix® material, it simultaneously pushes the hooks out of the way and pushes the screen down. After the wheel passes an area, the hooks return to their original positions. In returning to their original positions, the hooks engage the screen mesh. In this way, the combination of feed wheel and Aplix® material works much like a zipper. When removing the screen, the Aplix® material again works like a zipper by allowing the heads to move out of the way so that the screen can be released.

Figure 12:
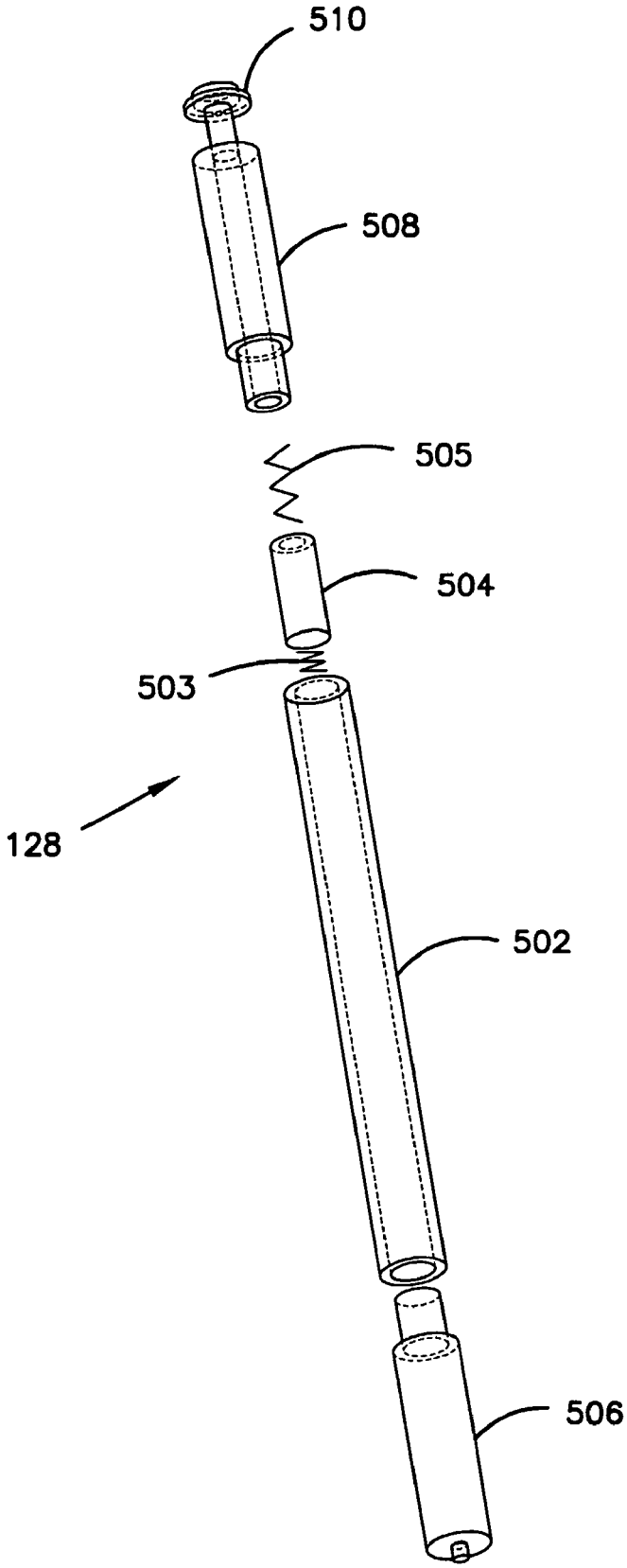
FIG. 12 is an exploded view of a roll core according to the principles of present invention.
Figure 13:
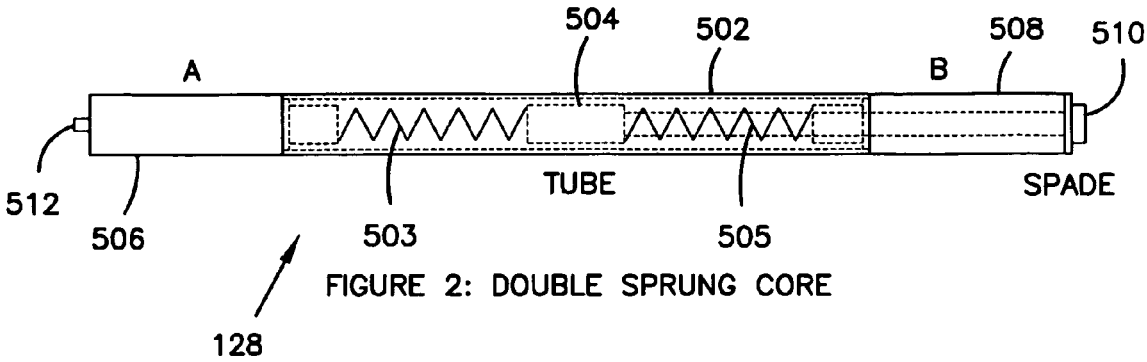
FIG. 13 is a top view of a roll core according to the principles of the present invention.

Turning now to the roll core, one embodiment of which is provided in FIGS. 12 and 13. FIG. 12 is an exploded view of the roll core shown in FIG. 13. Roll core 128 includes tube 502, spring anchor 504, ends 506 and 508 and springs 503 and 505. Springs 503 and 505 are torsion springs.

Tube 502 is a steel core with 0.625 inch outside diameter and a 0.040 inch thick wall. Using a steel core allows for a considerably smaller core in both diameter and wall thickness than cores of other materials. The more the core is allowed to deflect, the larger the cavity in the sash lower rail has to be to accommodate this extra movement. A steel core having an outside diameter of 0.625 inches, a wall thickness of 0.040 and a length of 36 inches will defect 0.031 inches at is center when subjected to a 3 pound load point load (maximum load seen to be on screen during normal operation). If the roll core 128 plus the screen wrapped around it were given 0.0625 inches of clearance all around (clearance from the walls of opening 126 in the bottom rail 124), there would remain 0.032 inches of clearance when subjected to the above load and deflection. A similar core made of 6061 aluminum would deflect 0.092 inches. To achieve the same amount of clearance in deflected state, the screen and roll core assembly would have to have 0.124 inches of clearance all around the roll and screen combination. In this specific example, switching roll core materials nearly doubles the clearance needed.

Using the steel core described above, a screen of approximately 23 inches in length can be wound having an outside diameter of 0.875 inches. The 0.625 inch core diameter with a 0.040 inch wall would allow adequate room within the inside diameter to house the spring return mechanism. Both ends of the roll core 128 are independently sprung with springs. This allows each end of the core to take up small amounts of slack created by window or track racking. Such a roll core as 128 may be referred to as a double sprung core. It should be noted that other types of roll cores and other dimensioned roll cores may certainly be used within the scope of this invention including a normal single sprung core.

The operation of the roll core 128 is as follows. Ends 506 and 508 are allowed to spin in the ends of the tube 502. The spade 510 is held fixed by its respective end cap. Pivot point 512 is allowed to rotate within its respective end cap. The double sprung core 128 uses two springs 503 and 505 that are both attached to the spring anchor 504 at the center of the core. Opposite end of spring 503 is then attached to end 506 while the opposite end of spring 505 is attached to end 508. Since the two ends 506 and 508 are not connected, each can spin independently of the other to release tension in their respective springs. In practice, the two sides are not truly independent because the screen mesh is attached to the roll core 128. The screen mesh is attached at three points: in the middle and at the ends 506 and 508. This allows the core to apply even take up tension when racking of the window occurs.

The above specification provides a description of some embodiments of the invention. However, it is noted that the present invention is not limited by the specific embodiments described herein. For example, but certainly not the only example, a sliding window could include first and second horizontal track members to provide an interface with the horizontal screen edges. In such an embodiment, the first member of the frame is a vertical member instead of a horizontal sill as in the case of the hung window illustrated and described in this specification. Another example of the scope of this invention extending beyond specific embodiments, can be seen in the form of the edge support of this invention. While specific embodiments of the edge support shown in the Figures include a separate track and fastener, the invention is certainly not limited to this configuration. For example, the track and fastener could be integral. Furthermore, the term "track" is not limited to U-shaped tracks. A track could simply be two parallel track members without a header. Furthermore, the track of this invention does not have to be a member that is separate from the frame. Moreover, the L-shape of the track 114 shown in FIG. 8 is not limiting. The track could certainly have many different shapes as long as an interface for securing the screen edges is provided. Since many embodiments in the invention can be made without departing from the spirit and scope of the invention, the invention resides in the claims hereafter appended.

We claim:

1. A fenestration unit including a screen coil apparatus comprising:

(a) a frame defining an opening, wherein the frame includes a first member;

(b) a sash slidably received in the opening, wherein the sash is movable in an opening direction away from the first member and in a closing direction toward the first member;

(c) a screen coil assembly comprising:

(i) a screen coil assembly capable of being coiled onto a roll core, a screen having an end and first and second edges wherein the end is attached to the first member;

(ii) the roll core attached to the sash for slidable movement therewith;

(d) an edge support comprising a first support member and a second support member having at least a portion located between the frame and sash, wherein the first and second support members are arranged longitudinally parallel to each other and parallel to the sliding motion of the sash, wherein the first edge of the screen is removably secured to the first support member and the second edge of the screen is removably secured to the second support member, and wherein when the end of the screen is attached to the first member of the frame and the sash is moved in the opening direction, the screen at least partially uncoils from the roll core wherein the edge support comprises a track and a fastener, wherein the first support member comprises a first track member and a first fastener attached to the first track member, and wherein the second support member comprises a second track member and a second fastener attached to a second lock;

(e) a fastening assist member for pressing the screen and the edge support together wherein the fastening assist member is a feed wheel connected to the sash.

2. The fenestration unit of claim 1 wherein the sash slides in a vertical direction.

3. The fenestration unit of claim 2 wherein the first member is a horizontal sill member and the opening direction is upward against gravity.

4. The fenestration unit of claim 1 wherein the first and second fasteners are reclosable fasteners.

5. The fenestration unit of claim 1 wherein the first and second fasteners are mushroom fasteners.

6. The fenestration unit of claim 1 wherein the track further comprises a header located perpendicular to, and connecting, the first and second track members.

7. The fenestration unit of claim 6 wherein the header, first track member and second track member comprise an integral member.

8. The fenestration unit of claim 6 wherein the header of the track is removably attachable to the first member of the frame wherein the header may be unfastened from the first member and slid toward the sash when the sash is at least partially opened for egress through the fenestration unit.

9. The fenestration unit of claim 1 wherein the sash includes a bottom rail defining an opening and the roll core is received by the opening.

10. The fenestration unit of claim 1 wherein the roll core is spring-loaded.

11. The fenestration unit of claim 10 wherein the roll core is a double sprung roll core.

12. A fenestration unit including a screen coil apparatus comprising:

(a) a frame defining an opening, wherein the frame includes a first member;

(b) a sash slidably received in the frame, wherein the sash is movable in an opening direction away from the first member and in a closing direction toward the first member;

(c) a screen coil assembly comprising:

(i) a screen capable of being coiled onto roll core means, the screen having an end and first and second edges wherein the end is attached to the first member;

(ii) the roll core means supporting the screen in a coiled configuration;

(d) edge support means including a structure to connect the first and second edges of the screen to the frame as the sash is moved in the opening direction, wherein the structure includes a feed wheel connected to the sash.

13. A hung window including a screen coil apparatus comprising:

(a) a frame defining an opening, wherein the frame includes a horizontal member;

(b) a sash slidably received in the opening, wherein the sash is movable in an opening direction from the horizontal member and in a closing direction toward the horizontal member, and wherein the sash includes a horizontal rail defining a horizontal rail opening;

(c) a screen coil assembly comprising:

(i) a screen capable of being coiled onto a roll core, the screen having a horizontal end and first and second vertical edges;

(ii) the roll core received in the horizontal rail opening and attached to the sash for slidable movement therewith;

(d) a track comprising first and second vertical track members connected by a horizontal header, wherein the end of the screen is attached to the header and the header is removably attachable to the horizontal member of the frame, and wherein the first and second track member are slidably received between the frame and sash;

(e) a first fastener attached to the first track member and a second fastener attached to the second track member, wherein when the header is attached to the horizontal member, movement of the sash in the opening direction at least partially uncoils the screen from the roll core and causes the first edge of the screen to be removably secured to the first fastener and the second edge of the screen to be removably secured to the second fastener;

(f) a fastening assist member for pressing the screen and the fastener together, wherein the fastening assist member is a feed wheel connected to the sash.

14. The fenestration unit of claim 13 wherein the first and second fasteners are reclosable fasteners.

15. The fenestration unit of claim 14 wherein the reclosable fasteners are mushroom fasteners.

16. The fenestration unit of claim 13 wherein the roll core is spring-loaded.

17. The fenestration unit of claim 13 wherein the horizontal member of the frame is a horizontal sill member and the opening direction of the sash is upward against gravity.

18. The fenestration unit of claim 13 wherein the horizontal member of the frame is a horizontal upper member and the opening direction of the sash is downward with gravity.

* * * * *